US009818329B2

(12) United States Patent
Park et al.

(10) Patent No.: US 9,818,329 B2
(45) Date of Patent: Nov. 14, 2017

(54) DATA DRIVING CIRCUIT, DISPLAY DEVICE HAVING THE SAME AND OPERATING METHOD THEREOF

(71) Applicant: SAMSUNG DISPLAY CO, LTD., Yongin-si, Gyeonggi-Do (KR)

(72) Inventors: Dongjoo Park, Gwangmyeong-si (KR); Sangmoon Moh, Hwaseong-si (KR); Young-Soo Hwang, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 57 days.

(21) Appl. No.: 14/864,039

(22) Filed: Sep. 24, 2015

(65) Prior Publication Data

US 2016/0284300 A1 Sep. 29, 2016

(30) Foreign Application Priority Data

Mar. 27, 2015 (KR) ..... 10-2015-0043533

(51) Int. Cl.
*G09G 3/20* (2006.01)
*G09G 3/36* (2006.01)

(52) U.S. Cl.
CPC ..... *G09G 3/20* (2013.01); *G09G 3/3648* (2013.01); *G09G 3/3688* (2013.01); *G09G 2310/027* (2013.01); *G09G 2330/021* (2013.01); *G09G 2370/08* (2013.01)

(58) Field of Classification Search
CPC ..... G09G 3/20; G09G 3/3648; G09G 3/3688
See application file for complete search history.

(56) References Cited

U.S. PATENT DOCUMENTS

| | | | | |
|---|---|---|---|---|
| 8,362,996 | B2 | 1/2013 | Huang et al. | |
| 2015/0213779 | A1* | 7/2015 | Baek | G09G 5/008 345/204 |
| 2015/0356932 | A1* | 12/2015 | Kim | G09G 3/3688 345/690 |

FOREIGN PATENT DOCUMENTS

| | | |
|---|---|---|
| KR | 1020090015375 | 2/2009 |
| KR | 1020110021386 | 3/2011 |
| KR | 1020130020338 | 2/2013 |
| KR | 1020130032059 | 4/2013 |
| KR | 1020130068723 | 6/2013 |
| KR | 1020140046092 | 4/2014 |
| KR | 1020140056775 | 5/2014 |

* cited by examiner

*Primary Examiner* — Ricardo L Osorio
(74) *Attorney, Agent, or Firm* — F. Chau & Associates, LLC

(57) ABSTRACT

Provided is a data driving circuit of a display device, the data driving circuit including a first receiving circuit which receives an external first image control signal at the start of power being supplied, a second receiving circuit which receives a second image control signal in response to an activated data packet detection signal, and a data packet detection circuit which activates the data packet detection signal when a line start field included in the first image control signal is detected.

15 Claims, 9 Drawing Sheets

DATA DRIVING CIRCUIT, DISPLAY DEVICE HAVING THE SAME AND OPERATING METHOD THEREOF

CROSS-REFERENCE TO RELATED APPLICATIONS

This application claims priority to Korean Patent Application No. 10-2015-0043533, filed on Mar. 27, 2015 in the Korean Intellectual Property Office, the disclosure of which is incorporated by reference herein.

BACKGROUND

1. Technical Field

The present disclosure herein relates to a display device including a data driving circuit.

2. Discussion of Related Art

Generally, display devices include a display panel for displaying images, and a data driving circuit and a gate driving circuit for driving the display panel. The display panel includes a plurality of gate lines, a plurality of data lines, and a plurality of pixels. Each of the plurality of pixels includes a switching transistor, a liquid crystal capacitor, and a storage capacitor. The data driving circuit outputs a data driving signal to the data lines, and the gate driving circuit outputs a gate driving signal to the gate lines.

These display devices may display images by applying a gate ON voltage to a predetermined gate line by means of the gate driving circuit, followed by providing a data voltage corresponding to an image signal to data lines by means of the data driving circuit. However, the data driving circuit may consume a great deal of current. Thus, there is a need for a more efficient data driving circuit that consumes less current.

SUMMARY

The present disclosure provides a data driving circuit that may be capable of preventing a malfunction caused by an over-current.

The present disclosure also provides a display device including the data driving circuit that may be capable of preventing a malfunction caused by an over-current.

The present disclosure also provides a method of operating the data driving circuit that may be capable of preventing a malfunction caused by an over-current.

According to an exemplary embodiment of inventive concept, a data driving circuit includes a first receiving circuit receiving an external first image control signal at the start of power being supplied to the data driving circuit, a second receiving circuit receiving a second image control signal in response to an activated data packet detection signal, and a data packet detection circuit activating the data packet detection signal when a line start field included in the first image control signal is detected.

In an embodiment, the data packet detection unit increments a count value whenever the line start field included in the first image control signal is detected, and activates the data packet detection signal when the count value reaches a predetermined value.

In an embodiment, the first image control signal includes the line start field, a configuration field, a pixel data field, and a wait field.

In an embodiment, the second receiving circuit maintains a disable state until the data packet detection signal is activated after the start of power being supplied.

In an embodiment, the first receiving circuit receives the first image control signal including a training pattern after the start of the power being supplied.

In an embodiment, the first receiving circuit receives the first image control signal including the line start field after receiving the first image control signal including the training pattern.

In an embodiment, the first image control signal includes a pair of differential signals.

In an embodiment, the second image control signal includes a pair of differential signals.

An exemplary embodiment of the inventive concept provides a display device including a display panel including a plurality of pixels respectively connected to a plurality of gate lines and a plurality of data lines, a gate driving circuit driving the plurality of gate lines, a data driving circuit driving the plurality of data lines in response to first and second image control signals, a driving controller controlling the gate driving circuit and providing the first and second image control signals to the data driving circuit, and a power supply supplying a power supply voltage. The data driving circuit includes a first receiving circuit receiving the first image control signal at the start of the power supply voltage being supplied to the data driving circuit from the power supply, a second receiving circuit receiving the second image control signal in response to an activated data packet detection signal, and a data packet detection circuit activating the data packet detection signal when a line start field included in the first image control signal is detected.

In an embodiment, the data packet detection circuit increments a count value whenever the line start field included in the first image control signal is detected, and activates the data packet detection signal when the count value reaches a predetermined value.

In an embodiment, the second receiving circuit maintains a disable state until the data packet detection signal is activated after the start of power supply voltage being supplied.

In an embodiment, the first receiving circuit receives the first image control signal including a training pattern after the start of the power supply voltage being supplied.

In an embodiment, the first receiving circuit receives the first image control signal including the line start field after receiving the first image control signal including the training pattern.

An exemplary embodiment of the inventive concept provides a method of operating a data driving circuit, the method including receiving a first image control signal via a first receiving circuit at the start of power being supplied to the data driving circuit, detecting whether a line start field is present in the first image control signal, activating a data packet detection signal when the line start field is detected, and receiving a second image control signal via a second receiving circuit in response to the activated data packet detection signal.

In an embodiment, the detecting of the line start field includes incrementing a count value whenever the line start field included in the first image control signal is detected, and activating the data packet detection signal when the count value reaches a predetermined value.

In an embodiment, the first image control signal includes the line start field, a configuration field, a pixel data field, and a wait field.

In an embodiment, the second receiving circuit maintains a disable state until the data packet detection signal is activated after the start of the power being supplied.

In an embodiment, a training pattern occurs in the first image control signal includes after the start of the power being supplied and the line start field occurs after the training pattern.

According to an exemplary embodiment, a data driving circuit is provided including first through fourth circuits. The first circuit is configured to output a control signal in an activated state when it detects a data packet within a first image control signal. The second circuit is configured to recover data voltages from received image control controls. The third circuit is configured to transmit the first image control signal to the first circuit and the second circuit, when power is supplied to the data driving circuit. The fourth circuit is configured to transmit a second image control signal to the second circuit upon receipt of the control signal in the activated state.

In an embodiment, the first circuit outputs the control signal in a deactivated state prior to detecting the data packet, and the fourth control circuit is disabled by the control signal set to the deactivated state.

BRIEF DESCRIPTION OF THE DRAWINGS

The inventive concept will become apparent from the following description with reference to the following figures, wherein like reference numerals refer to like parts throughout the various figures unless otherwise specified, and wherein.

DETAILED DESCRIPTION

Figure 1:
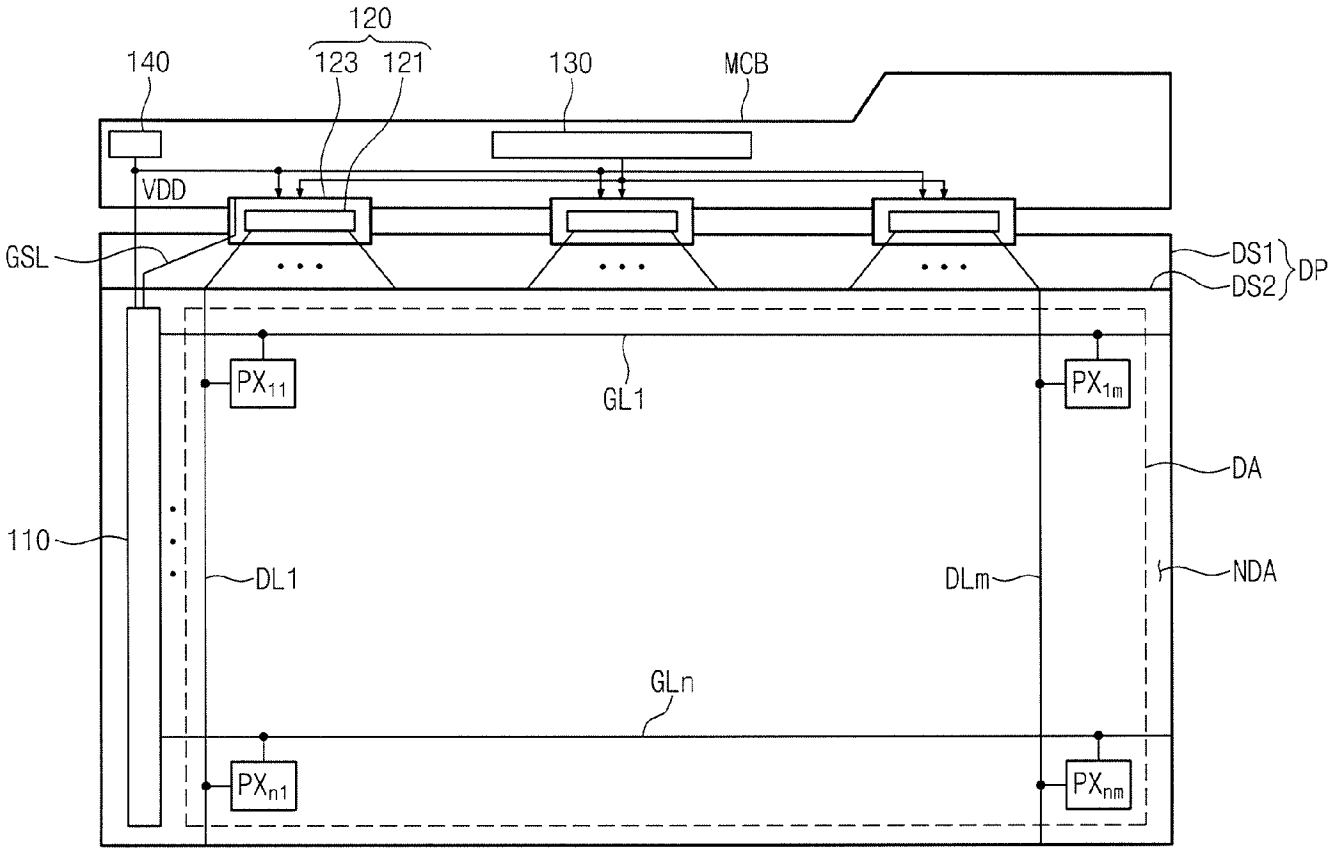
FIG. 1 is a plan view of a display device according to an exemplary embodiment of the inventive concept.

Hereinafter, embodiments of the inventive concept will be described in detail with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Unless otherwise noted, like reference numerals refer to like elements throughout the attached drawings and written description. In the drawings, the thickness or size of each layer may be exaggerated, omitted, or schematically illustrated for convenience in description and clarity. The terms of a singular form may include plural forms unless they have a clearly different meaning in the context. For example, the singular forms "a", "an" and "the" are intended to include the plural forms as well, unless the context clearly indicates otherwise.

Figure 2:
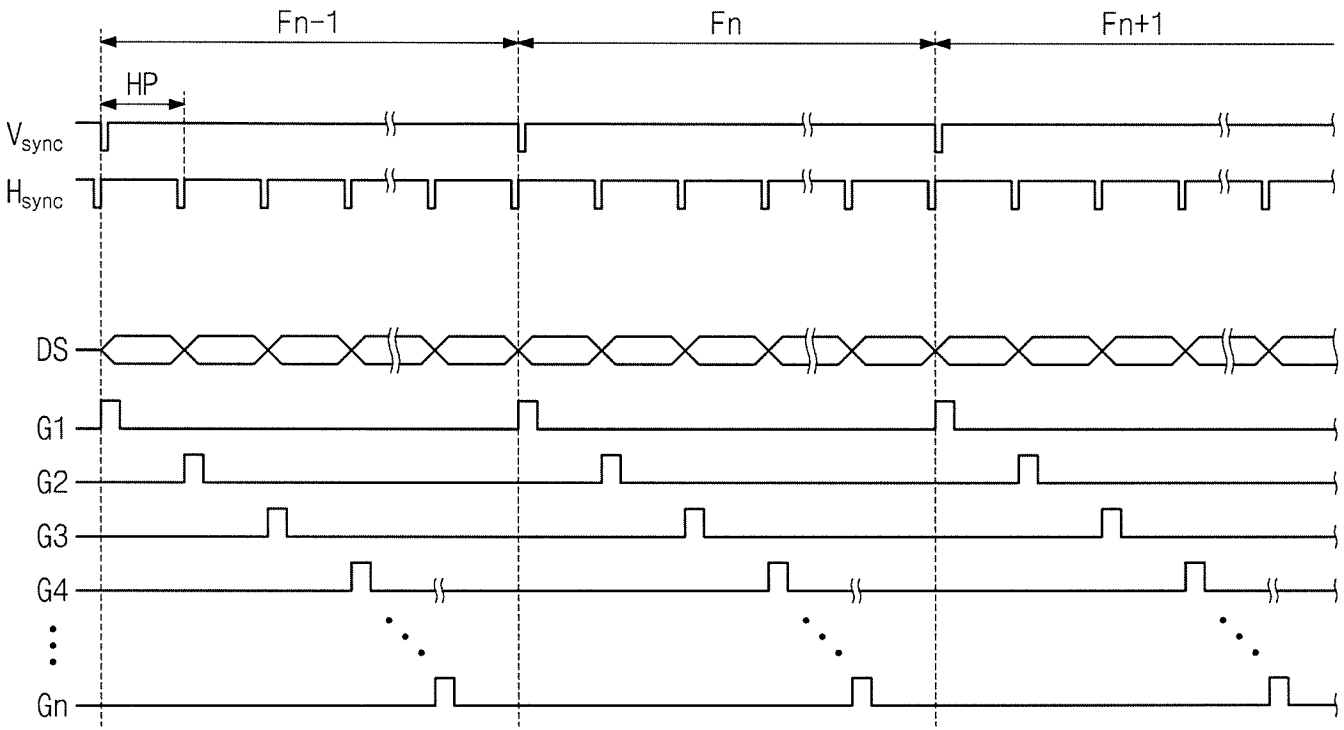
FIG. 2 is a timing diagram of signals of a display device according to an exemplary embodiment of the inventive concept.

FIG. 1 is a plan view of a display device according to an exemplary embodiment of the inventive concept. FIG. 2 is a timing diagram of signals of a display device according to an exemplary embodiment of the inventive concept.

As illustrated in FIGS. 1 and 2, the display device according to an embodiment of the inventive concept includes a display panel DP, a gate driving circuit 110, a data driving circuit 120, a driving controller 130, and a power supply 140.

Examples of the display panel DP may include, but are not limited to, a variety of display panels such as a liquid crystal display panel, an organic light emitting display panel, an electrophoretic display panel, and an electrowetting display panel. In embodiments of the inventive concept, the display panel DP is described as a liquid crystal display panel. In addition, a liquid crystal display device including the liquid crystal display panel may further include a polarizer, a backlight unit, and the like, which are not shown.

The display panel DP includes a display area DA on which a plurality of pixels $PX_{11}$ to $PX_{nm}$ are disposed and a non-display area NDA surrounding the display area DA. The display panel DP includes a plurality of gate lines GL1 to GLn disposed on a first substrate DS1 and a plurality of data lines DL1 to DLm which intersect with the gate lines GL1 to GLn. The plurality of gate lines GL1 to GLn are connected to the gate driving circuit 110. The plurality of data lines DL1 to DLm are connected to the data driving circuit 120. In FIG. 1, only some of the plurality of gate lines GL1 to GLn and some of the plurality of data lines DL1 to DLm are illustrated.

In FIG. 1, only some of the plurality of pixels $PX_{11}$ to $PX_{nm}$, are illustrated. The plurality of pixels $PX_{11}$ to $PX_{nm}$ are respectively connected to the plurality of gate lines GL1 to GLn and the plurality of data lines DL1 to DLm in a one-to-one correspondence.

The plurality of pixels $PX_{11}$ to $PX_{nm}$ may be divided into a plurality of groups according to colors displayed by the pixels. The plurality of pixels $PX_{11}$ to $PX_{nm}$ may display any one of a plurality of primary colors. The primary colors may include red, green, blue, and white. Alternatively, the primary colors are not limited thereto, but may further include various colors such as yellow, cyan, and magenta.

The gate driving circuit 110 and the data driving circuit 120 receive a control signal from the driving controller 130. The driving controller 130 may be mounted on a main circuit board MCB. The driving controller 130 receives image data and the control signal from an external graphic controller (not shown). The control signal may include a vertical synchronizing signal Vsync for distinguishing frame periods Fn−1, Fn, and Fn+1, a signal for distinguishing horizontal periods HP, that is a horizontal synchronizing signal Hsync for distinguishing rows, a data enable signal and a clock signal. In an embodiment, the data enable signal has a high level only during data output periods to indicate data input areas.

The gate driving circuit 110 generates gate signals G1 to Gn based on the control signal (hereinafter, referred to as a gate control signal) received from the driving controller 130 via a signal line GSL during the frame periods Fn−1, Fn, and Fn+1, and outputs the gate signals G1 to Gn to the plurality of gate lines GL1 to GLn. The gate signals G1 to Gn may be sequentially output to correspond to the horizontal periods HP. The gate driving circuit 110 may be formed simultaneously with the pixels $PX_{11}$ to $PX_{nm}$, through a thin film process. For example, the gate driving circuit 110 may be mounted on the non-display area NDA in the form of an oxide semiconductor TFT gate driver circuit (OSG).

FIG. 1 exemplarily illustrates a gate driving circuit 110 connected to left ends of the plurality of gate lines GL1 to GLn. In an embodiment of the inventive concept, the display device includes two gate driving circuits, where one of the two gate driving circuits is connected to left ends of the plurality of gate lines GL1 to GLn, and the other is connected to right ends of the plurality of gate lines GL1 to GLn. In an exemplary embodiment, one of the two gate driving circuits is connected to the odd-numbered gate lines, and the other is connected to the even-numbered gate lines.

The data driving circuit 120 outputs data signals D1 to Dm, which correspond to an image control signal received from the driving controller 130, to the plurality of data lines DL1 to DLm. Each data signal is set to a particular data voltage DS. In an example, a first group of the data signals (e.g., D1-D3) corresponds to or is derived from a first image control signal, a second group of data signals (e.g., D4-D6) corresponds to or is derived from a second image control signal, a third group of data signals (e.g., D7-D9) corresponds to or is derived from a third image control signal, etc. The use of three data signals per group and three groups is merely example, as each group may include greater than or less than three data signals, and there may be less than or greater than three groups.

The data voltages DS may include positive data voltages having positive values with respect to a common voltage, and/or negative data voltages having negative values with respect to the common voltage. During each of the horizontal periods HP, some of the data voltages applied to the data lines DL1 to DLm may have positive polarity, and the others may have negative polarity. The polarity of the data voltages DS may be inverted according to the frame periods Fn−1, Fn, and Fn+1 to prevent degradation of liquid crystal. The data driving circuit 120 may generate data voltages which are inverted at every frame period, in response to an inversion signal.

The data driving circuit 120 may include a driving chip 121 and a flexible circuit board 123 on which the driving chip 121 is mounted. The data driving circuit 120 may include a plurality of driving chips 121 and a plurality of flexible circuit boards 123. The flexible circuit board 123 electrically connects the main circuit board MCB to the first substrate DS1. The plurality of driving chips 121 provide corresponding data lines of the plurality of data lines DL1 to DLm with corresponding data signals.

FIG. 1 exemplarily illustrates a tape-carrier-package (TCP) type data driving circuit 120. In an exemplary embodiment of the inventive concept, the data driving circuit 120 is disposed on the non-display area NDA of the first substrate DS1 by a chip on glass (COG) method.

Data transfer rates may be enhanced by using a high-speed interface as an interface between the driving controller 130 and the data driving circuit 120. For example, an Advanced Intra Panel Interface (AiPi), a Universal Service Interface (USI), or the like may be used as the high-speed interface. Data transfer methods associated with these interfaces may be implemented in the high-speed interface. In an embodiment, the driving controller 130 uses the high-speed interface to transfer image control signals including an image data signal and a clock signal to the data driving circuit 120.

The power supply 140 may be mounted on the main circuit board MCB. The power supply 140 supplies a power supply voltage VDD required for the operation of the gate driving circuit 110 and the data driving circuit 120. The power supply 140 may further generate a power supply voltage required for the operation of the driving controller 130.

Figure 3:
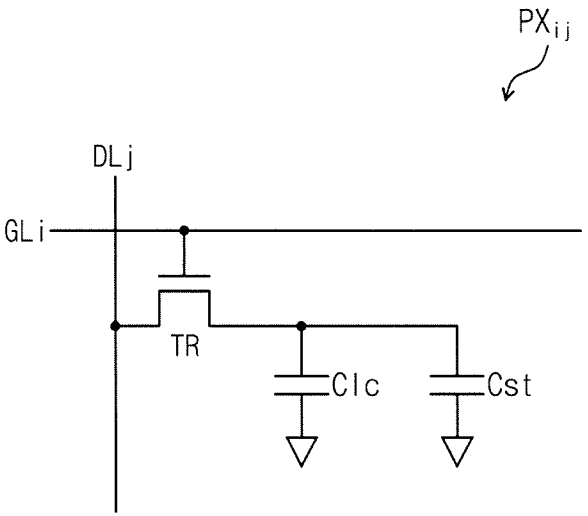
FIG. 3 is an equivalent circuit diagram of a pixel according to an exemplary embodiment of the inventive concept.

FIG. 3 is an equivalent circuit diagram of a pixel according to an exemplary embodiment of the inventive concept. Each of the plurality of pixels $PX_{11}$ to $PX_{nm}$ in FIG. 1 may have the equivalent circuit in FIG. 3.

As illustrated in FIG. 3, a pixel $PX_{ij}$ includes a pixel thin film transistor TR (hereinafter, referred to as a pixel transistor), a liquid crystal capacitor Clc, and a storage capacitor Cst. Hereinafter, the term transistor refers to a thin film transistor. In an embodiment of the inventive concept, the storage capacitor Cst may be omitted.

The pixel transistor TR is electrically connected to an i-th gate line GLi and a j-th data line DLj. The pixel transistor TR outputs a pixel voltage corresponding to a data signal received from the j-th data line DLj in response to a gate signal received from the i-th gate line GLi.

The liquid crystal capacitor Clc is charged with the pixel voltage output from the pixel transistor TR. The alignment of liquid crystal molecules included in a liquid crystal layer (not shown) varies depending on the amount of charge the liquid crystal capacitor Clc is charged with. Incident light on the liquid crystal layer passes therethrough or is blocked thereby according to the alignment of the liquid crystal molecules.

The storage capacitor Cst is connected in parallel to the liquid crystal capacitor Clc. The storage capacitor Cst maintains the alignment of the liquid crystal directors for a certain period.

Figure 4:
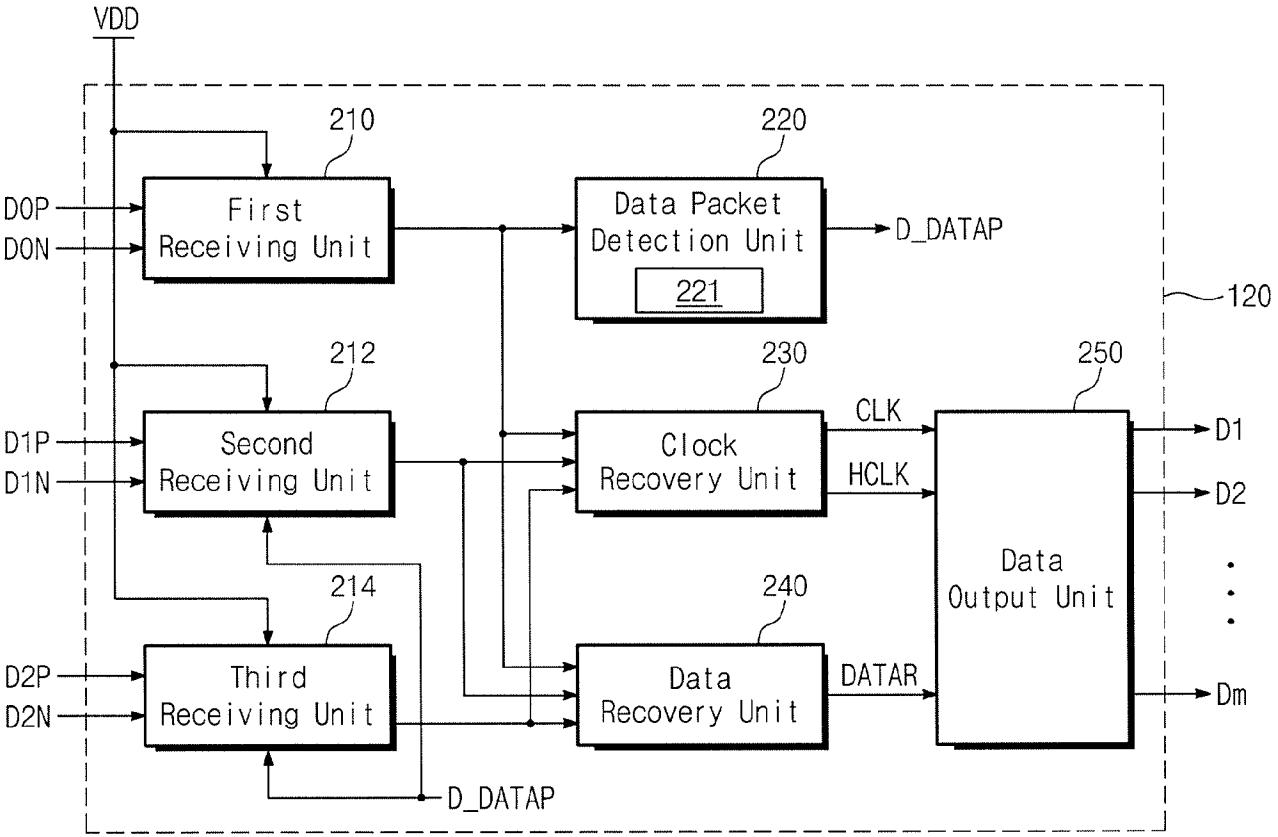
FIG. 4 is a block diagram exemplarily illustrating a configuration of the data driving circuit illustrated in FIG. 1.

FIG. 4 is a block diagram exemplarily illustrating a configuration of the data driving circuit illustrated in FIG. 1 according to an exemplary embodiment of the inventive concept.

Referring to FIG. 4, the data driving circuit 120 includes first to third receiving units 210, 212, and 214, a data packet detection unit 220 (e.g., a data packet detection circuit), a clock recovery unit 230 (e.g., a clock recovery circuit), a data recovery unit 240 (e.g., a data recovery circuit), and a data output unit 250 (e.g., a data output circuit/buffer).

The first receiving unit 210 receives first image control signals D0P and D0N provided from the driving controller 130 illustrated in FIG. 1. The second receiving unit 212 receives second image control signals D1P and D1N provided from the driving controller 130. The third receiving unit 214 receives third image control signals D2P and D2N provided from the driving controller 130. The first image control signals D0P and D0N is a first pair of differential signals, the second image control signals D1P and D1N is a second pair of differential signals, and the third image control signals D2P and D2N is a third pair of differential signals.

In the embodiment illustrated in FIG. 4, although the data driving circuit 120 includes the first to third receiving units 210, 212, and 214, the number of receiving units included in the data driving circuit 120 may be variously changed. For example, there may be fewer than three receiving units or more than three receiving units. Each of the first to third receiving units 210, 212, and 214 may be implemented by or include an equalizer (e.g., an equalizer circuit).

The data packet detection unit 220 detects a line start field included in the first image control signals D0P and D0N received from the first receiving unit 210, and activates a data packet detection signal D_DATAP. In an embodiment, the line start field is considered a line detection signal. The data packet detection unit 220 may include a counter 221

(e.g., a counter circuit). In an embodiment, the counter 221 is made up of a number of flip-flops connected in a cascade.

The clock recovery unit 230 recovers and outputs a clock signal CLK and a horizontal clock signal HCLK included in the first to third image control signals D0P to D2N received from the first to third receiving units 210, 212, and 214. The clock recovery unit 230 may include a phase locked loop (PLL) or a delay locked loop (DLL). The PLL or the DLL may be used to recover the clock signal CLK or the horizontal clock signal HCLK.

The data recovery unit 240 recovers an image data signal DATAR included in the first to third image control signals D0P to D2N received from the first to third receiving units 210, 212, and 214.

The data output unit 250 outputs data signals D1 to Dm corresponding to the image data signal DATAR from the data recovery unit 240, in synchronization with the clock signal CLK and the horizontal clock signal HCLK from the clock recovery unit 230. The data signals D1 to Dm are provided to the data lines DL1 to DLm illustrated in FIG. 1.

Figure 5:
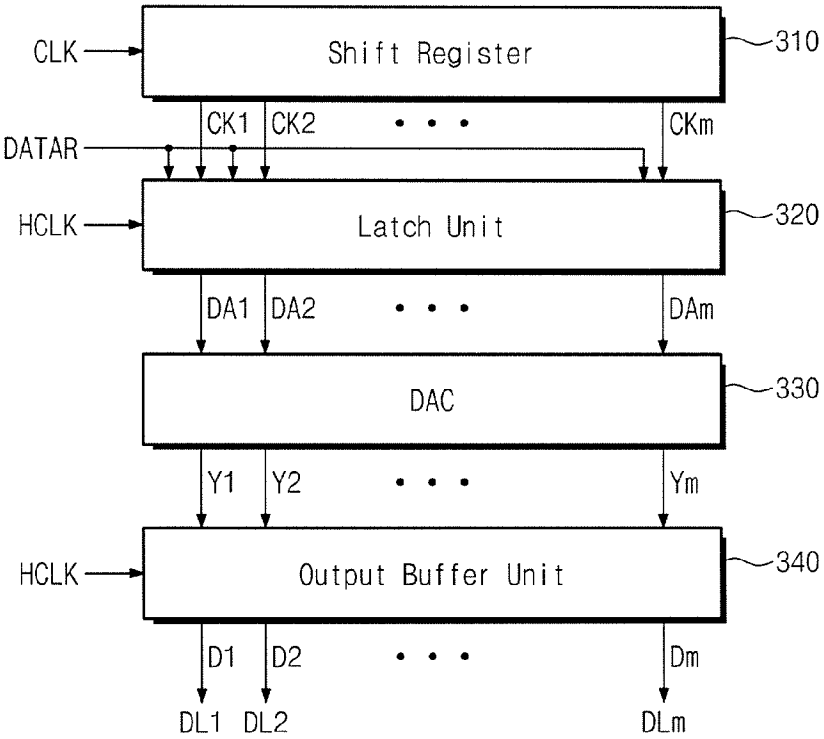
FIG. 5 is a block diagram exemplarily illustrating a configuration of the data output unit illustrated in FIG. 4.

FIG. 5 is a block diagram exemplarily illustrating a configuration of the data output unit illustrated in FIG. 4 according to an exemplary embodiment of the inventive concept.

Referring to FIG. 5, the data output unit 250 includes a shift register 310, a latch unit 320, a digital-to-analogue converter 330, and an output buffer unit 340. In an embodiment, the latch unit 320 includes several latches or flip-flops.

The shift register 310 sequentially activates latch clock signals CK1 to CKm in synchronization with the clock signal CLK. The latch unit 320 sequentially latches the image data signal DATAR in synchronization with the latch clock signals CK1 to CKm from the shift register 310, and provides latch data signals DA1 to DAm to the digital-to-analogue converter 330 at the same time in response to the horizontal clock signal HCLK.

The digital-to-analogue converter 330 outputs grayscale voltages Y1 to Ym, which correspond to the latch data signals DA1 to DAm from the latch unit 320, to the output buffer unit 340 in response to the horizontal clock signal HCLK. The output buffer unit 340 drives the data lines DL1 to DLm, with the grayscale voltages Y1 to Ym from the digital-to-analogue converter 330 as the data signals D1 to Dm.

Figure 6:
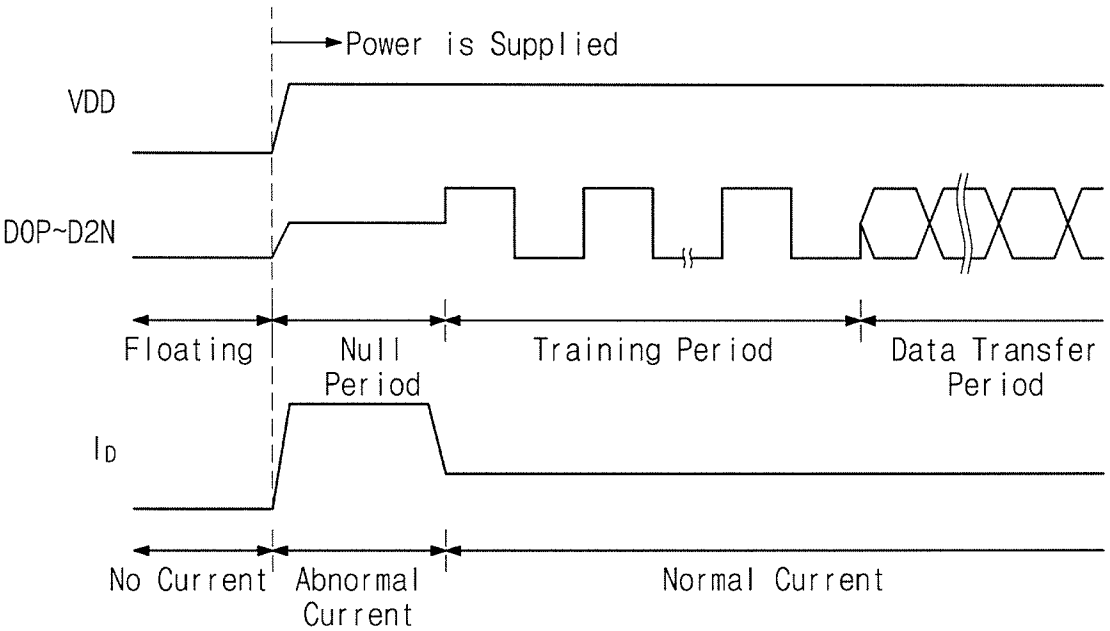
FIG. 6 exemplarily illustrates a change in the current consumed in the data driving circuit illustrated in FIG. 4.

FIG. 6 exemplarily illustrates a change in the current consumed in the data driving circuit illustrated in FIG. 4.

Referring to FIGS. 4 and 6, before the start of the supply of the power supply voltage VDD, the first to third image control signals D0P to D2N provided to the first to third receiving units 210, 212, and 214 from the driving controller 130 are in a floating state.

During a predetermined null period after the start of the supply of the power supply voltage VDD, the driving controller 130 provides the first to third image control signals D0P to D2N having the same signal level to the first to third receiving units 210, 212, and 214. In an embodiment, this signal level is higher than the level of the signals in the floating state.

After the predetermined null period, the driving controller 130 provides the first to third image control signals D0P to D2N including a training pattern to the first to third receiving units 210, 212, and 214. In an embodiment, the training pattern in a given image control signal indicates that a line start field is the next field to be received in the given image control signal. In an embodiment, the level of an image control signal in the training period periodically toggles between two levels, where the highest level among the two levels is higher than the level of the signal during the null period, and the lowest level among the two levels is lower than the level of the signal during the null period.

The first to third receiving units 210, 212, and 214 may include an equalizer which corrects the signal so that the amplitude of a pair of differential signals received is kept constant, and a skew adjustment circuit which corrects the skew of a pair of differential signals. For example, if the amplitude of one of the signals of the pair of differential signals is supposed to have a first value, and the amplitude becomes a second value different from the first value, the equalizer may be used to set the amplitude back to the first value. For example, if the phase between a pair of different signals is supposed to be a first value, and the phase becomes a second value different from the first value, the skew adjustment circuit may be used to set the phase back to the first value.

If the first to third image control signals D0P to D2N having the same signal level during the null period are provided to the first to third receiving units 210, 212, and 214, the first to third receiving units 210, 212, and 214 then operate with a maximum current consumption. That is, the current consumption in the data driving circuit 120 during the null period rapidly increases.

The power supply voltage VDD supplied from the power supply 140 illustrated in FIG. 1 is provided to the gate driving circuit 110 as well as the data driving circuit 120. When the current consumption in the data driving circuit 120 rapidly increases, the amount of current provided to the gate driving circuit 110 may be reduced. This may result in a malfunction of the display device.

Figure 7:
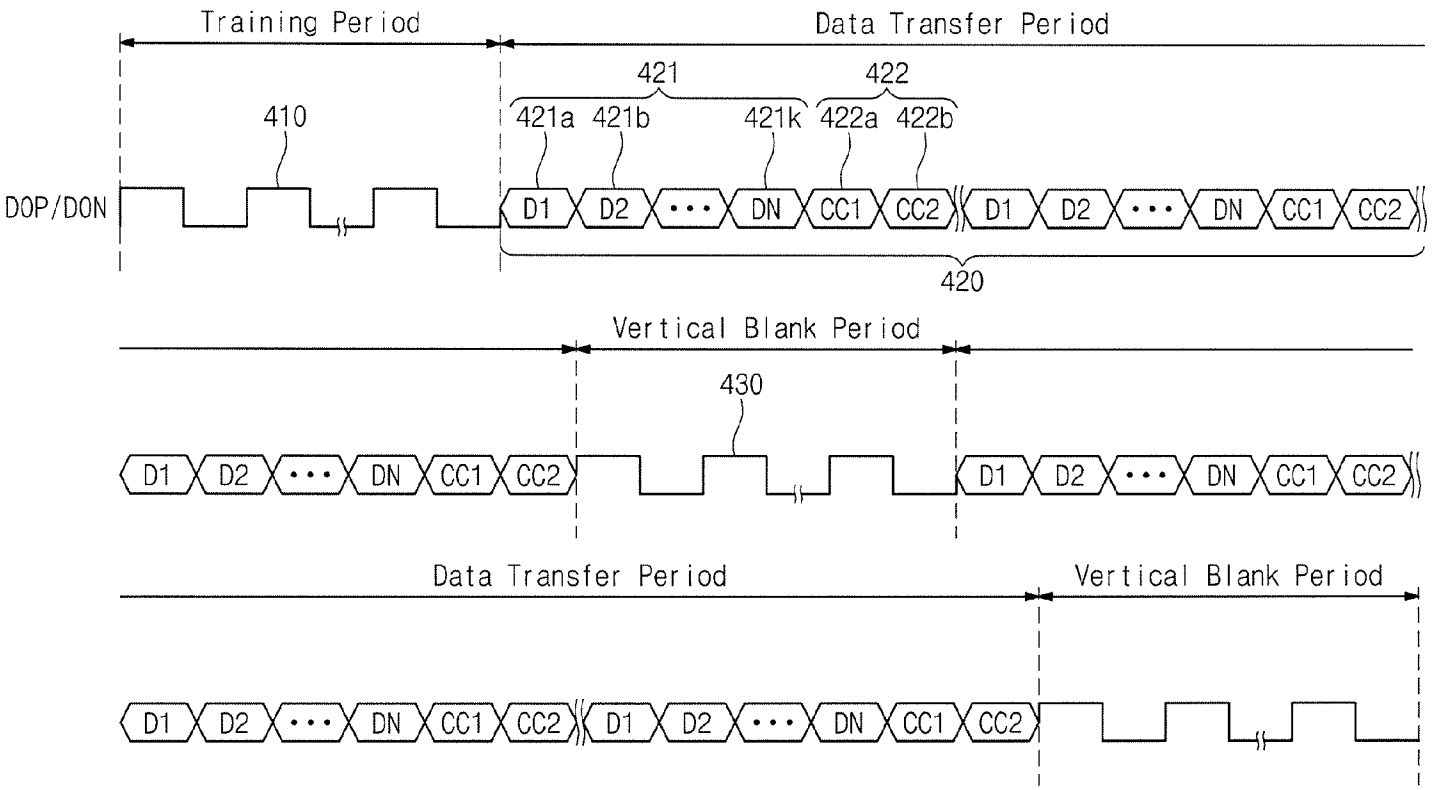
FIG. 7 exemplarily illustrates an image control signal provided to the data driving circuit from the driving controller illustrated in FIG. 1.

FIG. 7 exemplarily illustrates an image control signal provided to the data driving circuit from the driving controller illustrated in FIG. 1.

Referring to FIG. 7, during a training period, the driving controller 130 transfers a training signal 410 to the data driving circuit 120. During a data transfer period, the driving controller 130 transfers data packets respectively corresponding to the lines of a frame of image data. A data packet 420 includes a plurality of data bits 421 and clock codes 422 periodically added to the plurality of data bits 421. The clock code 422 may be added to each of the plurality of data bits 421*a* to 421*k*. In an embodiment, the clock code 422 has two bits including a first bit 422*a* and a second bit 422*b*. In an embodiment, the clock code 422 has a single bit. During a vertical blank period following the transfer of data packets for one image frame, the driving controller 130 transfers a modulated clock signal 430 to the data driving circuit 120. The data transfer period and the vertical blank period may be repeated.

Figure 8:
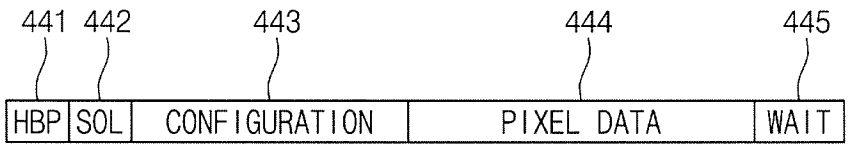
FIG. 8 illustrates a data packet transferred during a data transfer period in the display device in FIG. 1.

FIG. 8 illustrates a data packet transferred during a data transfer period in the display device in FIG. 1.

Referring to FIG. 8, the data packet 420, which is transferred during the data transfer period, includes a horizontal blank field 441, a line start field 442, a configuration field 443, a pixel data field 444, and a wait field 445.

The horizontal blank field 441 is a period which is assigned for the data driving circuit 120 to secure the time for providing the data signals D1 to Dm to the data lines. For example, the horizontal blank field 441 may have a number of bits corresponding to the time at which the latch data signals DA1 to DAm output from the latch unit 320 illustrated in FIG. 5 are converted to the grayscale voltages Y1 to Ym by the digital-to-analogue converter 330 and then output as the data signals D1 to Dm. For example, the bits of the horizontal blank field 441 may indicate a particular length of time.

The horizontal blank field 441 may include clock codes having edges of a certain direction, or having a certain pattern so as to be separated from the line start field 442. The edges of the certain direction or the certain pattern may be used so that the horizontal blank field 441 can be distinguished from the start field 442.

The line start field 442 indicates the start of each line within a frame of image data. For example, the frame may include multiple lines of image data corresponding to respective rows of the display panel, and the line start field 442 associated with a given line may indicate the start of the given line. The data driving circuit 120 may operate an internal counter in response to the line start field 442, and separate the configuration field 443, the pixel data field 444, and the wait field 445 based on the counting result of the counter. For example, if each of the fields has a known number of edges, once the counter exceeds one of these edge counts, it can be determined that a new field has been encountered, and the counter can be reset to count the next field. The line start field 442 may include a clock code having a specific edge or pattern for the separation from the horizontal blank field 441 for the previous line or the vertical blank period between the current image frame and the previous image frame.

In the configuration field 443, configuration data for controlling the data driving circuit 120 is written. The driving controller 130 may transfer the configuration field 443, in which the configuration data is written, to the data driving circuit 120, thereby requiring no separate control signal line for transferring a control signal. The configuration data may include a frame synchronization signal which is activated when the data packet 420 for the last line of a frame is transferred. In an embodiment, the frame synchronization signal is activated when the last data packet 420 for the last line of the frame is transferred. When a data packet 420 for a line other than the last line is transferred, the frame synchronization signal is deactivated. The data driving circuit 120 may receive the activated frame synchronization signal, thereby recognizing the start of the vertical blank period after the current data packet is transferred. The configuration data may further include set values such as bias values and equalization options for the first to third receiving units 210, 212, and 214.

In the pixel data field 444, image data is written. The data driving circuit 120 may receive the image data written in the pixel data field 444, and output the data signals D1 to Dm so that an image corresponding to the image data is displayed in the display panel DP. The wait field 445 is a period which is assigned to the data driving circuit 120 to secure the time for receiving and storing the image data. For example, the wait field 445 may have a number of bits corresponding to the time at which the data driving circuit 120 in FIG. 1 receives the image data and stores the image data in the latch unit 320 illustrated in FIG. 5. For example, the bits of the wait field 445 may indicate a particular length of time.

Referring to FIG. 4 again, the data packet detection unit 220 detects the line start field 442 in the data packet 420 illustrated in FIG. 8, from the signal received from the first receiving unit 210. The counter 221 in the data packet detection unit 220 increments a count value whenever the line start field 442 is detected. The data packet detection unit 220 activates the data packet detection signal D_DATAP when the count value reaches a predetermined value (e.g., 4). Prior to the count value reaching the predetermined value, the data packet detection unit 220 maintains the data packet detection signal D_DATAP at a deactivated state.

The second and third receiving units 212 and 214 receive the second image control signals D1P and D1N and the third image control signals D2P and D2N when the data packet detection signal D_DATAP is active. In an exemplary embodiment, the second and third receiving units 212 and 214 receive the second image control signals D1P and D1N and the third image control signals D2P, and only perform an operation (e.g., an equalization or skew correction) on the received image control signals when the data packet detection signal D_DATAP is active. For example, the second and third receiving units 212 and 214 are disabled or deactivated when the data packet detection signal D_DATAP has the deactivated state.

Figure 9:
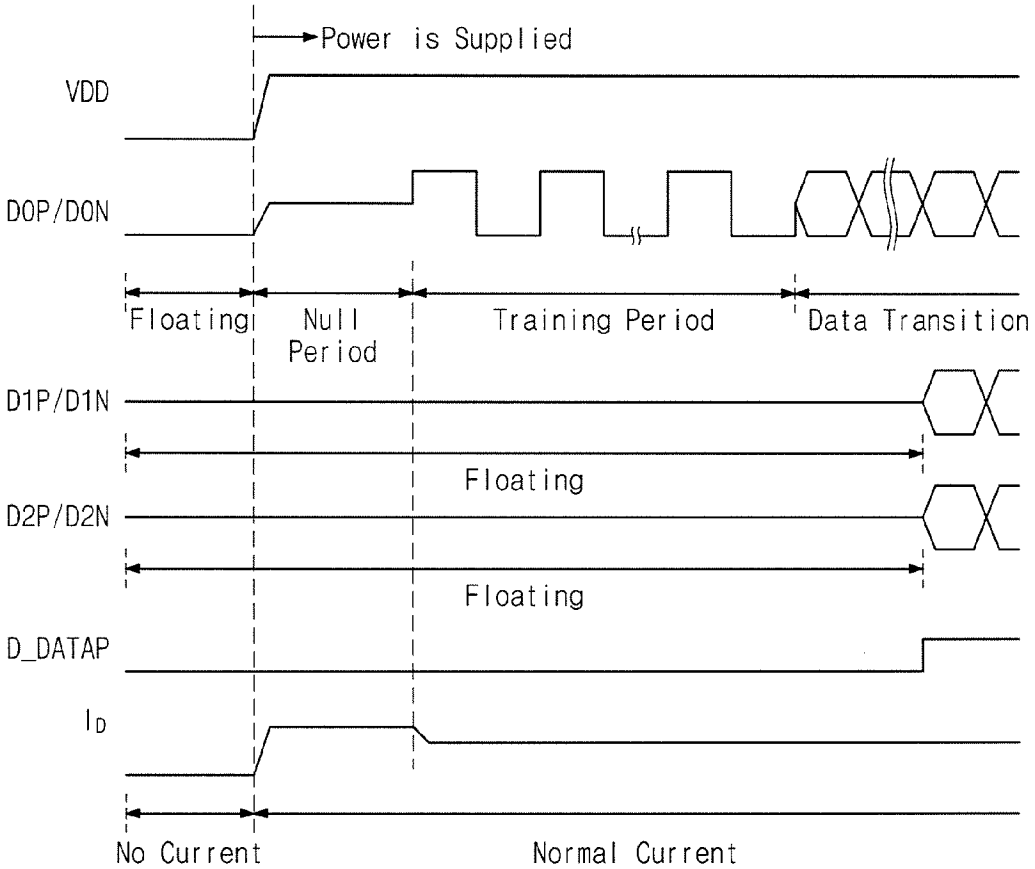
FIG. 9 exemplarily illustrates a change in the current consumed in the data driving circuit illustrated in FIG. 4.

FIG. 9 exemplarily illustrates a change in the current consumed in the data driving circuit illustrated in FIG. 4.

Referring to FIGS. 4 and 9, before the start of the supply of the power supply voltage VDD, the first to third image control signals D0P to D2N provided to the first to third receiving units 210, 212, and 214 from the driving controller 130 are in a floating state.

During a predetermined null period after the start of the supply of the power supply voltage VDD, the driving controller 130 provides the first to third image control signals D0P to D2N having the same signal level to the first to third receiving units 210, 212, and 214. The first receiving unit 210, which is enabled simultaneously with the start of the supply of the power supply voltage VDD, receives the first image control signals D0P and D0N. However, the second and third receiving units 212 and 214 are in a disabled state, and thus do not receive the second image control signals D1P and D1N and the third image control signals D2P and D2N. In an embodiment, the second and third receiving units 212 and 214 receive the received image control signals in the disabled state, but are incapable of performing an operation on the image received image control signals in the disabled state.

After the predetermined null period passes, the first receiving unit 210 sequentially receives the training signal 410 and the data packet 420. When the data packet detection unit 220 activates the data packet detection signal D_DATAP to a high level, the second and third receiving units 212 and 214 begin to receive the second image control signals D1P and D1N and the third image control signals D2P and D2N. In an embodiment, the second and third receiving units 212 and 214 receive the second image control signals D1P and D1N and the third image control signals D2P and D2N, respectively, but do not perform operations on the received image control signals until data packet detection unit 220 activates the data packet detection signal D_DATAP to a high level.

During the null period, only the first receiving unit 210 receives the first image control signals D0P and D0N having the same signal level, and thus the rapid increase in the current consumption in the data driving circuit 120 during the null period may be prevented. In an embodiment, only the first receiving unit 210 is capable of performing an operation on its received image control signals having the same signal level, and thus the rapid increase in the current consumption in the data driving circuit 120 during the null period may be prevented. After the power supply voltage VDD is supplied, current in a normal range is consumed in the data driving circuit 120, so that stable operation of the display device may be maintained.

According to an exemplary embodiment of the inventive concept, a data driving circuit is provided that includes: a first circuit configured to output a control signal in an activated state when it detects a data packet within a first image control signal; a second circuit configured to recover data voltages from received image control controls; a third circuit configured to transmit the first image control signal to the first circuit and the second circuit, when power is supplied to the data driving circuit; a fourth circuit configured to transmit a second image control signal to the second circuit upon receipt of the control signal in the activated state. Elements 220, 240, 210, and 214 of FIG. 4 are examples of the first-fourth circuits, respectively. The above described data packet detection signal D_DATAP is an example of the control signal.

In an embodiment, the first circuit outputs the control signal in a deactivated state prior to detecting the data packet, and the fourth circuit is disabled by the control signal set to the deactivated state so that the second circuit does receive the second image control signal.

In an embodiment, the first image control signal corresponds to part of a display panel and the second image control signal corresponds to another part or a remaining part of the display panel. For example, the first image control signal could correspond to the data lines in a first half of the display panel and the second image signal corresponds to the data lines in a second half of the display panel. For example, when the first circuit has detected that data packets for the first half of the display panel have been received, the first circuit can set the control signal to an activated level to enable the fourth circuit to transmit the second image control signal to the second circuit so its data voltages can then be recovered.

A data driving circuit of at least one of the above described embodiments, at the start of power supply, allows only one receiving unit of the plurality of receiving units be in a normal operating state, and sets the remaining receiving units to be in a disable state. Accordingly, after the start of power supply, an over-current may be prevented from flowing through the plurality of receiving units by virtue of image control signals being in a floating state.

Although exemplary embodiments of the present inventive concept have been disclosed for illustrative purposes, those skilled in the art will appreciate that various modifications, additions and substitutions are possible, without departing from the scope and spirit of the inventive concept. Therefore, it should be understood that the above embodiments are not limiting, but illustrative.

What is claimed is:

1. A data driving circuit, comprising:

a first receiving circuit configured to receive an external first image control signal and output the received first image control signal at the start of power being supplied to the data driving circuit;

a second receiving circuit configured to maintain a disable state after the start of the power being supplied; and a data packet detection circuit configured to receive the first image control signal output by the first receiving circuit, activate a data packet detection signal when a line start field included in the first image control signal is detected, and output the activated data packet detection signal to the second receiving circuit, wherein the second receiving circuit is activated and receives an external second image control signal when the data packet detection signal is activated.

2. The data driving circuit of claim 1, wherein the data packet detection circuit increments a count value whenever the line start field included in the first image control signal is detected, and activates the data packet detection signal when the count value reaches a predetermined value.

3. The data driving circuit of claim 1, wherein the first image control signal comprises the line start field, a configuration field, a pixel data field, and a wait field.

4. The data driving circuit of claim 1, wherein the first receiving circuit receives the first image control signal including a training pattern after the start of the power being supplied.

5. The data driving circuit of claim 4, wherein the first receiving circuit receives the first image control signal including the line start field after receiving the first image control signal including the training pattern.

6. The data driving circuit of claim 1, wherein the first image control signal comprises a pair of differential signals.

7. The data driving circuit of claim 1, wherein the second image control signal comprises a pair of differential signals.

8. A display device, comprising:

a display panel including a plurality of pixels respectively connected to a plurality of gate lines and a plurality of data lines;

a gate driving circuit configured to drive the plurality of gate lines;

the data driving circuit of claim 1 configured to drive the plurality of data lines with the image data;

a driving controller configured to control the gate driving circuit and provide the first and second image control signals to the data driving circuit; and a power supply configured to supply a power supply voltage.

9. The data driving circuit of claim 1, further comprising a control circuit configured to recover a clock signal and the image data from both the output image controls signal, and output the image data to data lines in synchronization with the clock signal.

10. The data driving circuit of claim 1, wherein the second circuit is configured to recover a clock signal from the first image control signal and the second image control signal, and output the recovered data voltages to the data lines in synchronization with the clock signal.

11. A method of operating a data driving circuit, the method comprising:

outputting, by a first receiving circuit of the data driving circuit, a first image control signal at the start of power being supplied to the data driving circuit;

maintaining, by a second receiving circuit of the data driving circuit, a disable state at the start of the power being supplied to the data driving circuit;

activating, by a data packet detection circuit of the data driving circuit, a data packet detection signal when the data packet detection circuit detects a line start field is present within the output first image control signal;

outputting, by the data packet detection circuit, the activated data packet detection signal;

activating the second receiving circuit of the data driving circuit, when the data packet detection signal is activated;

outputting, by the second receiving circuit of the data driving circuit, a second image control signal; and recovering by the data driving circuit, image data from both the image control signals output by the receiving circuits.

12. The method of claim 11, wherein the detecting of the line start field comprises:

incrementing a count value whenever the line start field included in the first image control signal is detected; and activating the data packet detection signal when the count value reaches a predetermined value.

13. The method of claim 11, wherein the first image control signal comprises the line start field, a configuration field, a pixel data field, and a wait field.

14. The method of claim 11, wherein a training pattern occurs in the first image control signal after the start of the power being supplied and the line start field occurs after the training pattern.

15. The method of claim 11, further comprising:

recovering, by the data driving circuit, a clock signal from the image control signals output by the receiving circuits; and outputting, by the data driving circuit, the image data to a plurality of data lines in synchronization with the clock signal.

* * * * *